US008815018B2

(12) United States Patent
Housmekerides et al.

(10) Patent No.: US 8,815,018 B2
(45) Date of Patent: Aug. 26, 2014

(54) DETERGENT DOSING DEVICE

(75) Inventors: Chris Efstathios Housmekerides, Ludwigshafen (DE); Karl Ludwig Gibis, Limburgerhof (DE)

(73) Assignee: Reckitt Benckiser N.V., Hoofddorp (NL)

( * ) Notice: Subject to any disclaimer, the term of this patent is extended or adjusted under 35 U.S.C. 154(b) by 1028 days.

(21) Appl. No.: 12/601,891

(22) PCT Filed: May 23, 2008

(86) PCT No.: PCT/GB2008/001753

§ 371 (c)(1),
(2), (4) Date: Apr. 6, 2010

(87) PCT Pub. No.: WO2008/145968

PCT Pub. Date: Dec. 4, 2008

(65) Prior Publication Data

US 2010/0186781 A1 Jul. 29, 2010

(30) Foreign Application Priority Data

May 30, 2007 (GB) ..... 0710229.6

(51) Int. Cl.
*D06F 39/02* (2006.01)
*A47L 15/44* (2006.01)

(52) U.S. Cl.
CPC ..... *A47L 15/44* (2013.01); *D06F 39/024* (2013.01)
USPC ..... 134/115 R; 134/93; 134/57 D; 134/113; 134/18; 134/56 D; 68/17 R; 222/52

(58) Field of Classification Search
CPC ..... A47L 15/4463; A47L 15/4472; A47L 15/4445; A47L 15/0055; A47L 15/4436
USPC ..... 134/93, 18, 56 R, 57 R, 58 R, 98.1, 3, 88, 134/897; 68/17 R; 222/52, 135, 190; 422/106, 108, 110
See application file for complete search history.

(56) References Cited

U.S. PATENT DOCUMENTS 2,315,890 A 4/1943 Bader
2,370,609 A 2/1945 Wilson
(Continued)

FOREIGN PATENT DOCUMENTS

CA 2235889 A1 10/1999
CA 2313356 A1 1/2001
(Continued)

OTHER PUBLICATIONS

English Abstract for DE3513640 published Oct. 16, 1986.
(Continued)

*Primary Examiner* — Michael Barr
*Assistant Examiner* — Thomas Bucci
(74) *Attorney, Agent, or Firm* — Norris McLaughlin & Marcus PA

(57) ABSTRACT

The invention concerns detergent dosing devices and particularly a device for metering detergent doses within a dishwashing machine. A detergent dosing device in accordance with an embodiment of the invention comprises: a water/wash liquor collection area (12), a controlled inlet valve (14) for receiving water/wash liquor from the water/wash liquor collection area (12) and selectively allowing the collected water/wash liquor to pass through it, a housing part 10 for receiving water/wash liquor passed to it by the controlled inlet valve (14), a detergent supply (16) for mixing with said water/wash liquor, a first sensor (18) for sensing the cleanliness level of water/wash liquor, a second sensor (20) for sensing detergent, a controller (22) for receiving signals from said first and second sensors (18, 20) and for selectively controlling said inlet valve (14) on the basis of the outputs from the first and second sensors and an outlet (28) for dispensing mixed water/wash liquor and detergent.

14 Claims, 1 Drawing Sheet

(56) References Cited

U.S. PATENT DOCUMENTS

Figure 1:
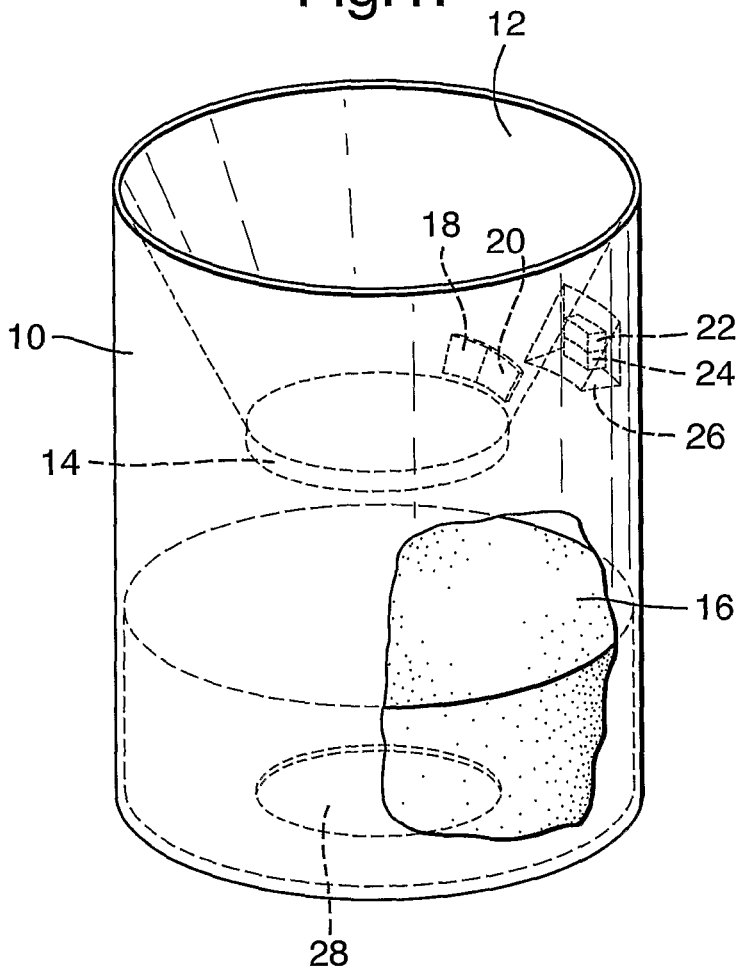

| | | | | |
|---|---|---|---|---|
| 2,514,000 | A | 7/1950 | Kent | |
| 2,777,570 | A | 1/1957 | Mytinger | |
| 2,880,077 | A | 3/1959 | Floria | |
| 2,954,145 | A | 9/1960 | McCauley | |
| 3,063,459 | A | 11/1962 | Jacobs | |
| 3,091,402 | A | 5/1963 | Palmer | |
| 3,187,767 | A | 6/1965 | Sherrard | |
| 3,198,010 | A | 8/1965 | Huston | |
| 3,272,899 | A | 9/1966 | Diamond et al. | |
| 3,411,671 | A | 11/1968 | Harvey et al. | |
| 3,482,740 | A | 12/1969 | Evans et al. | |
| 3,494,436 | A | 2/1970 | Lanning | |
| 3,688,795 | A | 9/1972 | Taylor | |
| 3,759,284 | A | 9/1973 | Crowley et al. | |
| 3,822,561 | A | 7/1974 | Miller | |
| 4,055,278 | A | 10/1977 | Seymour | |
| D269,801 | S | 7/1983 | Sangster et al. | |
| 4,416,859 | A | 11/1983 | Brown et al. | |
| D273,033 | S | 3/1984 | Sangster et al. | |
| 4,436,269 | A | 3/1984 | Dirksing et al. | |
| D280,757 | S | 9/1985 | Paulovich et al. | |
| 4,545,917 | A | 10/1985 | Smith et al. | |
| 4,700,554 | A | 10/1987 | Eichman et al. | |
| 4,707,866 | A | 11/1987 | Von Philipp et al. | |
| 4,835,804 | A | 6/1989 | Arnau-Munoz et al. | |
| D304,102 | S | 10/1989 | Lakhan et al. | |
| 4,917,272 | A | 4/1990 | Ikeda | |
| D308,739 | S | 6/1990 | Nystuen | |
| 4,999,124 | A | 3/1991 | Copeland | |
| 5,033,643 | A | 7/1991 | Schumacher | |
| 5,088,517 | A | 2/1992 | Bersch | |
| D328,332 | S | 7/1992 | Fink | |
| D328,333 | S | 7/1992 | Casberg | |
| 5,137,694 | A | 8/1992 | Copeland et al. | |
| 5,186,912 | A | 2/1993 | Steindorf et al. | |
| 5,194,230 | A | 3/1993 | PeKarna et al. | |
| 5,251,777 | A | 10/1993 | McMahon | |
| 5,262,132 | A | 11/1993 | Bricker et al. | |
| D346,890 | S | 5/1994 | Panesar | |
| 5,310,060 | A | 5/1994 | Bitner et al. | |
| 5,310,430 | A | 5/1994 | McCall | |
| 5,474,211 | A | 12/1995 | Hellenberg | |
| 5,500,050 | A * | 3/1996 | Chan et al. | 134/18 |
| 5,549,074 | A | 8/1996 | Hui | |
| D376,320 | S | 12/1996 | Lathrop et al. | |
| 5,603,233 | A | 2/1997 | Erickson | |
| D381,141 | S | 7/1997 | Balz | |
| 5,643,591 | A | 7/1997 | Mehra et al. | |
| D383,264 | S | 9/1997 | Balz | |
| 5,679,173 | A | 10/1997 | Hartman | |
| 5,681,400 | A | 10/1997 | Brady | |
| 5,685,178 | A | 11/1997 | Ahn | |
| 5,785,180 | A | 7/1998 | Dressel et al. | |
| 5,807,906 | A | 9/1998 | Bonvallot et al. | |
| 5,830,576 | A | 11/1998 | Mehra et al. | |
| 5,870,906 | A | 2/1999 | Denisar | |
| 5,967,158 | A | 10/1999 | Smith et al. | |
| 5,971,154 | A | 10/1999 | Toren | |
| 6,048,501 | A | 4/2000 | Lemaire et al. | |
| 6,058,946 | A | 5/2000 | Bellati et al. | |
| 6,173,743 | B1 | 1/2001 | Ibanez Sapina | |
| 6,178,987 | B1 | 1/2001 | Caruthers, Jr. et al. | |
| 6,263,708 | B1 | 7/2001 | Yarmosky | |
| 6,375,038 | B1 | 4/2002 | Daansen et al. | |
| 6,375,956 | B1 | 4/2002 | Hermelin et al. | |
| D457,596 | S | 5/2002 | Guzman et al. | |
| 6,463,766 | B2 | 10/2002 | Kubota et al. | |
| D465,258 | S | 11/2002 | Hiranaga et al. | |
| 6,536,060 | B1 * | 3/2003 | Janssens et al. | 8/159 |
| 6,540,081 | B2 | 4/2003 | Balz et al. | |
| 6,571,993 | B2 | 6/2003 | Rodd et al. | |
| 6,576,599 | B1 | 6/2003 | Stone | |
| 6,581,800 | B2 | 6/2003 | Rodd et al. | |
| 6,589,925 | B1 | 7/2003 | Binstock | |
| 6,608,022 | B1 | 8/2003 | Zabarylo et al. | |
| D481,844 | S | 11/2003 | Greene et al. | |
| 6,681,963 | B2 | 1/2004 | Hague et al. | |
| D513,928 | S | 1/2006 | Birdsell et al. | |
| D526,043 | S | 8/2006 | Thompson | |
| D529,128 | S | 9/2006 | Lee | |
| 7,156,353 | B2 | 1/2007 | Kringel et al. | |
| 7,188,521 | B2 | 3/2007 | Fling et al. | |
| D539,993 | S | 4/2007 | Brandt | |
| 7,219,518 | B2 | 5/2007 | Aouad et al. | |
| D547,912 | S | 7/2007 | Brandt | |
| 7,276,470 | B2 | 10/2007 | Hahn | |
| D564,141 | S | 3/2008 | Gaa et al. | |
| D564,142 | S | 3/2008 | Gaa et al. | |
| D564,143 | S | 3/2008 | Gaa et al. | |
| D568,555 | S | 5/2008 | Gaa et al. | |
| 7,421,867 | B2 | 9/2008 | Bongini | |
| 7,428,831 | B2 | 9/2008 | Cho et al. | |
| D601,766 | S | 10/2009 | Gaa et al. | |
| D604,466 | S | 11/2009 | Gaa et al. | |
| D608,960 | S | 1/2010 | Gaa et al. | |
| 7,913,639 | B2 | 3/2011 | Canavoi et al. | |
| 2001/0010165 | A1 | 8/2001 | Kubota et al. | |
| 2002/0004472 | A1 | 1/2002 | Holderbaum et al. | |
| 2002/0169092 | A1 | 11/2002 | Alexandre Catlin et al. | |
| 2003/0052138 | A1 | 3/2003 | Smith | |
| 2003/0168085 | A1 | 9/2003 | Sowle et al. | |
| 2003/0182732 | A1 | 10/2003 | Davenet et al. | |
| 2004/0011693 | A1 | 1/2004 | Prenger et al. | |
| 2004/0053808 | A1 | 3/2004 | Raehse et al. | |
| 2004/0088796 | A1 | 5/2004 | Neergaard et al. | |
| 2004/0103925 | A1 | 6/2004 | Marettek | |
| 2004/0206133 | A1 | 10/2004 | Woo et al. | |
| 2004/0216499 | A1 | 11/2004 | Bongini | |
| 2004/0217125 | A1 | 11/2004 | Marone | |
| 2005/0023290 | A1 | 2/2005 | Kon et al. | |
| 2005/0039781 | A1 | 2/2005 | Song et al. | |
| 2005/0109860 | A1 | 5/2005 | Chiang et al. | |
| 2005/0121058 | A1 | 6/2005 | Furber et al. | |
| 2005/0139241 | A1 | 6/2005 | Jowett et al. | |
| 2005/0148497 | A1 | 7/2005 | Khan | |
| 2005/0235704 | A1 | 10/2005 | Cho et al. | |
| 2006/0258556 | A1 | 11/2006 | Holderbaum et al. | |
| 2007/0000068 | A1 | 1/2007 | Gerad France et al. | |
| 2007/0295036 | A1 | 12/2007 | Brandt et al. | |
| 2008/0053187 | A1 | 3/2008 | Koring | |
| 2008/0053494 | A1 | 3/2008 | Moro et al. | |

FOREIGN PATENT DOCUMENTS

| | | | |
|---|---|---|---|
| DE | 2244722 | | 10/1973 |
| DE | 2244722 | A1 | 10/1973 |
| DE | 3513640 | A1 | 10/1986 |
| DE | 8814550 | U1 | 1/1989 |
| DE | 4400417 | A1 | 7/1995 |
| DE | 19516312 | C1 | 8/1996 |
| DE | 19540608 | | 5/1997 |
| DE | 19652733 | A1 | 6/1998 |
| DE | 19740819 | A1 | 3/1999 |
| DE | 19740819 | | 5/1999 |
| DE | 19836857 | | 2/2000 |
| DE | 19930771 | A1 | 1/2001 |
| DE | 10044495 | A1 | 10/2002 |
| EP | 0391087 | A1 | 10/1990 |
| EP | 0 457 137 | | 5/1991 |
| EP | 0481547 | | 4/1992 |
| EP | 0521179 | | 1/1993 |
| EP | 0863200 | A2 | 9/1998 |
| EP | 0903405 | A2 | 3/1999 |
| EP | 0906747 | | 4/1999 |
| FR | 2723751 | A1 | 2/1996 |
| FR | 2723752 | | 2/1996 |
| GB | 820327 | | 9/1959 |
| GB | 1142238 | | 2/1969 |
| GB | 1198251 | | 7/1970 |
| GB | 2037719 | A | 7/1980 |
| GB | 1592357 | | 7/1981 |
| GB | 2104109 | A | 3/1983 |
| GB | 2134654 | A | 8/1984 |
| GB | 2244722 | A | 12/1991 |

(56) References Cited

FOREIGN PATENT DOCUMENTS

| | | | |
|---|---|---|---|
| GB | 2339678 | | 2/2000 |
| GB | 2356842 | | 6/2001 |
| GB | 2386129 | | 9/2003 |
| GB | 2386130 | A | 9/2003 |
| GB | 2402604 | A | 12/2004 |
| GB | 2402679 | | 12/2004 |
| GB | 2406821 | A | 4/2005 |
| GB | 2417492 | A | 3/2006 |
| JP | 01-317493 | | 12/1989 |
| JP | 2000317350 | A | 11/2000 |
| JP | 2003260130 | A | 9/2003 |
| JP | 2006061450 | | 3/2006 |
| JP | 2006122196 | A | 5/2006 |
| KR | 950002460 | B1 | 3/1995 |
| SU | 838371 | B | 6/1981 |
| WO | 8806199 | A1 | 8/1988 |
| WO | 96 38638 | | 12/1996 |
| WO | 9712539 | | 4/1997 |
| WO | 0107702 | A | 2/2001 |
| WO | 0107703 | A1 | 2/2001 |
| WO | 0178572 | A2 | 10/2001 |
| WO | 0220893 | A | 3/2002 |
| WO | 0276278 | | 3/2002 |
| WO | 02051704 | A1 | 7/2002 |
| WO | 02058528 | A1 | 8/2002 |
| WO | 2003 07 39 06 | | 9/2003 |
| WO | 03073907 | A2 | 9/2003 |
| WO | 2004033297 | | 4/2004 |
| WO | 2004041248 | | 5/2004 |
| WO | 2004044303 | A | 5/2004 |
| WO | 2004059068 | | 7/2004 |
| WO | 2004 08 55 95 | | 10/2004 |
| WO | 2005099552 | A2 | 10/2005 |
| WO | 2006000237 | A1 | 1/2006 |
| WO | 2006 021760 | A1 | 3/2006 |
| WO | 2006021760 | A2 | 3/2006 |
| WO | 2006021761 | A1 | 3/2006 |
| WO | 2006021773 | A1 | 3/2006 |
| WO | 2007 05 19 89 | | 5/2007 |
| WO | 2007083142 | A1 | 7/2007 |

OTHER PUBLICATIONS

English Abstract for KR950002460 published Mar. 20, 1995.
English Translation of DE8814550 published Jan. 19, 1989.
English language translation for EP 0863200 published Sep. 9, 1998.
English language translation for EP 0931087 published Oct. 10, 1990.
English language translation for DE 10044495 published Oct. 24, 2002.
International Search Report PCT/GB2005/003271.
Written Opinion PCT/GB2005/003271.
Written Opinion PCT/GB2005/003265.
International Search Report PCT/GB2005/003265.
English Translation of application FR 2723751 taken from esp@net.com.
English Translation application DE 19740819 A1 taken from esp@net.com.
English Translation application DE 19516312 C1 taken from esp@net.com.
English Translation of EP 0906747 provided by esp@cenet.
English Abstract of JP 2000-317350 taken from espa@cenet.
English Abstract of JP 2003-260130 taken from espa@cenet.
English Abstract of JP 2006-122196 taken from espa@cenet.
English Abstract of KR 2002001154 in Office Action dated Oct. 26, 2011 of related U.S. Appl. No. 12/447,509.
English Translation application DE 4400417 taken from esp@cenet.com.
Certified Copy of English-Language Translation of EP 0 906 747 A2.
English Language Abstract for DE19652733 taken from esp©cenet.com.

* cited by examiner

DETERGENT DOSING DEVICE

This is an application filed under 35 USC 371 of PCT/GB2008/001753.

The invention related to improvements to a detergent dosing device for use within ware washing machines and in particular to providing an arrangement in which doses may be varied.

In automatic dishwashing machines, the detergent, whether in powder, tablet or gel form, is usually filled manually by the user into the machine, in particular into a detergent holder, before each dishwashing operation.

This filling process is inconvenient, with the problem of exact metering of the detergent and possible spillage thereof, for powder and gel detergents. Even with detergents in tablet form, wherein the problem of accurate dosing is overcome, there is still the necessity of handling the dishwashing detergent every time a dishwashing cycle is started. This is inconvenient because of the usually corrosive nature of dishwasher detergent compositions.

A number of devices are known for holding unit doses of a detergent composition or additive, such as detergent tablets, and for dispensing of such unit doses into a machine.

WO 01/07703 discloses a device for the metered release of a detergent composition or additive into a dishwashing machine having a number of separate sealed chambers for holding the detergent composition or additive and means for piercing the chambers, activated by conditions within the machine.

WO 03/073906 discloses a free standing device for dispensing multiple doses of detergent into a dishwasher. The device has a plate-like construction. A round blister pack having a plurality of doses arranged around its periphery is loaded into the pack. A winder is then rotated to load mechanical energy into the device sufficient to dispense more than one dose of detergent. A thermally operated latch then moves when the device is subjected to the elevated temperatures within the dishwasher and, in cooperation with a ratchet mechanism, moves the blister pack so that the next dose of detergent is ready for dispensing. In order to dispense the detergent, either the blister pack is pierced, or the dose is ejected from its compartment within the blister pack.

WO 03/073907 discloses a similarly shaped free standing dispensing device. In order to dispense detergent, a lever is manually operated to move a blister pack either to eject the detergent from a compartment within the blister pack, or to pierce the blister pack. A door or flap initially prevents wash liquor within the machine from accessing the exposed detergent. A bi-metallic strip is provided to move the door or flap when the device is exposed to the elevated temperatures during a washing cycle to allow access of the wash liquor to the exposed detergent thereby dispensing the detergent to the machine.

In all of the above arrangements, there are disadvantages in that the doses of detergent are predetermined and do not reflect the actual conditions within the dishwasher at any given point in time and do not, for instance, take account for the dirtiness of the water within the machine.

According to a first aspect of the invention, there is provided a detergent dosing device comprising:

a water/wash liquor collection area;

a housing part for receiving water/wash liquor passed to it;

a detergent supply for mixing with said water/wash liquor in said housing;

means for controlling inflow of water/wash liquor to the device in response to sensed conditions; and an outlet for dispensing mixed water/wash liquor and detergent.

Preferably, inflow is controlled in response to a sensed cleanliness level of water/wash liquor and/or in response to a sensed concentration level of detergent.

In preferred embodiments, the device comprises a controlled inlet valve for receiving water/wash liquor from the water/wash liquor collection area and selectively allowing the collected water/wash liquor to pass through it in response to at least one sensed condition; and a controller for receiving signals regarding said at least one sensed condition and selectively controlling said inlet valve.

The means for controlling inflow of water/wash liquor to the device preferably comprises a first sensor for sensing the cleanliness level of water/wash liquor and a second sensor for sensing detergent and said controller receives signals from said first and second sensors and selectively controls said inlet valve on the basis of the outputs from said first and second sensors.

Preferably the power source for the device is a battery power source, contained within the device. Batteries have been found to survive the fluctuating temperature and humidity conditions in a washing environment without detriment to their usage.

Preferably, said first sensor is a turbidity sensor and the second sensor is a conductivity sensor. The turbidity sensor preferably senses the cleanliness of the water/wash liquor being received at the device, whilst the conductivity sensor indicates the amount of detergent within the water/wash liquor.

Preferably, the controller is arranged to vary the amount of water/wash liquor admitted into the housing based upon the signals from the first and second sensors. The controller preferably has access to a look up table specifying valve opening values against first and second sensor output values and varies the valve opening according to said values.

Preferably, said controlled inlet valve is controlled so as to be openable by predetermined amounts and times according to conditions sensed by the first and second sensors.

Said detergent supply may comprise a solid block of detergent or a supply of liquid or powder detergent.

Preferably the dosing device contains a plurality of detergent sources. These may be dosed individually into wash liquor, in different cleaning operations. For example there may be an array of detergent sources arranged, separate, in a cylindrical manner. The device may be arranged so that water is fed, in any given cleaning operation, to one detergent source only. The device may have an indexing arrangement so that in the next cleaning operation it is one of the remaining detergent sources which is washed out. The nature of such operations is immaterial to an understanding of the present invention, but if the reader requires further information he could refer to, for example, GB 0621574.3 or PCT/GB2007/000175.

Preferably the device is fittable to/detachable from a ware-washing machine by an end user (as distinct from being a build-in module of the machine).

Preferably the dosage containers are provided in refill form.

In accordance with a second aspect of the present invention there is provided a ware-washing machine (preferably an automatic dishwashing machine) provided with a multi-dosing delivery device of the first aspect. Preferably the device is such that it may be fitted into (and preferably removable from) a machine by an end user. Preferably permanent machine adaptations are not needed. Thus in simple terms the device is preferably an "add-on" to an existing machine.

Figure 2:
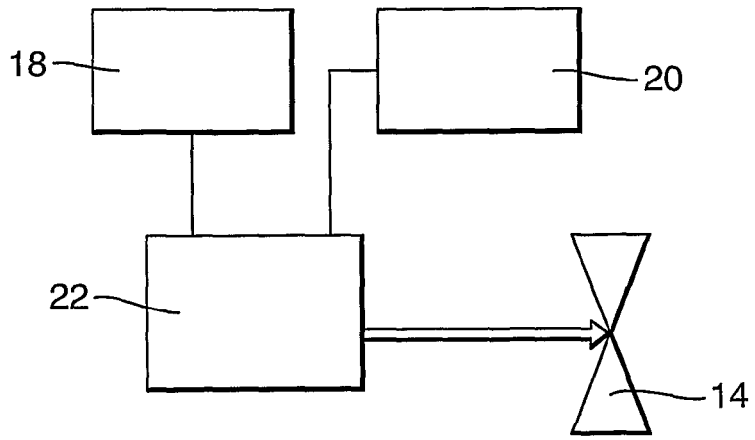

For a better understanding of the invention, and to show how embodiments of the same may be carried into effect, reference will now be made, by way of example, to the accompanying diagrammatic drawings in which:

FIG. 1 is a schematic representation of a device for varying detergent dosage in accordance with an embodiment of the invention; and FIG. 2 is a schematic diagram illustrating a way in which the detergent dosage may be varied.

Referring now to FIG. 1, there is shown a housing 10, water/wash liquor collection area 12, a controlled inlet valve 14, a detergent supply 16, first and second sensors 18, 20, a controller 22 and a battery 24. The controller 22 and battery 24 are provided within a protective inner housing 26. The housing 10 further includes an outlet 28 for allowing water/wash liquor and detergent to exit the housing 10.

The housing 10 contains all of the component parts of the device.

The water/wash liquor collection area comprises a funnel type arrangement placed at the top part of the housing 10 for collecting water/wash liquor from the dishwasher environment. The first and second sensors 18, 20 are located within the funnel area and are, respectively, a turbidity sensor and a conductivity sensor.

At the exit of the funnel there is positioned the controlled inlet valve 14, which may be a controlled iris type arrangement for providing a variable aperture opening into a main interior of the housing 10 so as to provide a potentially infinitely variable control of inflow of water/wash liquor into the device.

Within the main interior of the housing 10, there is located a block of detergent 16, which may be housed in a sub-compartment and receives the water/wash liquor from the controlled inlet valve 14. Also within the interior part of the housing 10 there is located the protective inner housing 26 in which the controller 22 and battery 24 are situated and protected from the hostile environment of the dishwasher.

Operation of the device of FIG. 1 will now be described with the aid of the schematic diagram shown in FIG. 2.

FIG. 2 shows the first, turbidity, sensor 18, the second, conductivity, sensor 20, the controller 22 and the controlled inlet valve 14.

The turbidity sensor 18 senses the level of cleanliness of the water within the water/wash liquor collection area 12, whilst the conductivity sensor 20 measures the conductivity of the water/wash liquor—which provides an indication as to the level of detergent present within the water/wash liquor.

The controller 22 receives the signals output from the first and second sensors 18, 20 and processes those signals accordingly. In a preferred arrangement the controller 22 utilises a look up table pre-programmed into memory (not shown) which instructs the controller 22 as to whether, how much and for how long the controller should open the controlled valve 14 on the basis of the received signal from the sensors 18, 20. For instance, if the turbidity sensor 18 indicates a high level of dirtiness and the conductivity sensor 20 indicates a low level of detergent, then the controlled inlet valve 14 may be opened accordingly by a predetermined amount and for a predetermined period to allow water/wash liquor to mix with detergent within the housing 10 and exit through the outlet 28. A subsequent re-polling of the sensors 18, 20 will then determine whether a sufficient dosage is now present within the water/wash liquor and a subsequent adjustment (opening of the valve for a given period and by a given amount) may be made.

It will be understood by the person skilled in the art that various modifications to the arrangements described above may be made without departing from the scope of the invention.

For instance, whilst a block of detergent is shown, a liquid supply of detergent could be used and provided with its own metered valve so as to enable controlled amounts of detergent to be issued on the basis of the sensed conditions. In such a case there may further be provided a sensor for sensing the actual amount of detergent dispensed from the liquid supply.

The skilled man will also appreciate that whilst two sensors are discussed in relation to the preferred embodiments, inflow to the device may be controlled in response to any number of sensors from one to many for sensing any desired number of conditions giving a picture of conditions within the dishwashing environment.

In a variation, one or more sensors could be placed so as to sense conditions outside of the water/wash liquor collection area.

It will be understood that whilst the controller may be a digital electronics component such as a microprocessor, it could instead be replaced by discrete digital or analogue components.

Although the invention is primarily directed towards the dishwashing environment, it will be understood that it may alternatively be used for other applications such as clothes washing etc.

The invention claimed is:

1. A detergent dosing device comprising:

a water/wash liquor collection area which contains water/wash liquor present within a ware washing machine;

a housing part for receiving water/wash liquor received from the ware washing machine;

a detergent supply adapted for mixing with said water/wash liquor present within said housing;

a controllable inlet valve for receiving water/wash liquor from the water/wash liquor collection area and selectively allowing the collected water/wash liquor to pass from the water/wash liquor collection area and into the housing in response to at least one sensed condition;

at least one sensor;

a controller for receiving signals from said at least one sensor, and for selectively controlling said inlet valve wherein the amount of inflow water/wash liquor collected from the water/wash liquor present within the ware washing machine is metered to the detergent supply present within the housing;

and an outlet for dispensing mixed water/wash liquor and detergent from within said housing, outwardly to the interior of the ware washing machine;

and, a power source; wherein the device is portable, and is removable and insertable by a consumer in a ware washing machine.

2. A device according to claim 1, wherein inflow is controlled in response to a sensed cleanliness level of water/wash liquor sensed by the at least one sensor.

3. A device according to claim 1, wherein inflow of water/wash liquor through the inlet valve is controlled in response to a sensed concentration level of detergent present in the water/wash liquor.

4. A device according to claim 1, comprises a first sensor for sensing the cleanliness level of water/wash liquor and a second sensor for sensing detergent level in the water/wash liquor, and said controller receives signals from said first and second sensors and selectively controls said inlet valve on the basis of the outputs from said first and second sensors.

5. A device according to claim 4, wherein said first sensor is a turbidity sensor.

6. A device according to claim 4, wherein said second sensor is a conductivity sensor.

7. A device according to claim 1, wherein the controller is arranged to vary the amount of water/wash liquor admitted into the housing based upon signals from the first sensor and a further, second sensor present in the device.

8. A device according to claim 7, wherein the controller controls the inlet valve by referring to a look up table having valve settings for different values of signals received from said first and second sensors.

9. A device according to claim 7, wherein said controlled inlet valve is controlled to be openable by predetermined amounts and times according to conditions sensed by the first and second sensors.

10. A device according to claim 1, wherein the device has a battery power source.

11. A device according to claim 1, wherein said detergent supply comprises a solid block of a detergent.

12. A device according to claim 1, wherein said detergent supply comprises a supply of a liquid detergent.

13. A ware washing machine comprising a detergent dosing device according to claim 1.

14. A ware washing machine according to claim 13, wherein the ware washing machine is an automatic dishwashing machine.

* * * * *